US011725663B2

(12) United States Patent
Diedrichsen et al.

(10) Patent No.: US 11,725,663 B2
(45) Date of Patent: Aug. 15, 2023

(54) ROTARY PISTON PUMP HAVING A FILTER

(71) Applicant: Gebr. Becker GmbH, Wuppertal (DE)

(72) Inventors: Frank Diedrichsen, Wuppertal (DE); Marcel Kuethe-Schleifenbaum, Remscheid (DE); Dirk Wallat-Thaler, Gevelsberg (DE); Henryk Waniek, Solingen (DE)

(73) Assignee: Gebr. Becker GmbH, Wuppertal (DE)

( * ) Notice: Subject to any disclaimer, the term of this patent is extended or adjusted under 35 U.S.C. 154(b) by 212 days.

(21) Appl. No.: 17/429,708

(22) PCT Filed: Feb. 3, 2020

(86) PCT No.: PCT/EP2020/052591

§ 371 (c)(1),
(2) Date: Aug. 10, 2021

(87) PCT Pub. No.: WO2020/164943

PCT Pub. Date: Aug. 20, 2020

(65) Prior Publication Data

US 2022/0145888 A1 May 12, 2022

(30) Foreign Application Priority Data

Feb. 13, 2019 (DE) ..... 10 2019 103 577.5

(51) Int. Cl.
*F04C 29/00* (2006.01)
*F04C 18/12* (2006.01)
*F04C 29/12* (2006.01)

(52) U.S. Cl.
CPC ..... *F04C 29/0092* (2013.01); *F04C 18/123* (2013.01); *F04C 29/12* (2013.01); *F04C 2230/85* (2013.01); *F04C 2240/30* (2013.01)

(58) Field of Classification Search
CPC .... F04C 29/0092; F04C 29/12; F04C 29/124; F04C 18/123; F04C 18/0215; F04C 18/16;

(Continued)

(56) References Cited

U.S. PATENT DOCUMENTS 4,938,316 A * 7/1990 Ichikawa ..... F04C 14/06 184/27.2
6,062,827 A * 5/2000 Shu ..... F04C 18/086 417/313

(Continued)

FOREIGN PATENT DOCUMENTS

DE 199 27 531 A1 12/2000
WO 2016/034485 A2 3/2016

OTHER PUBLICATIONS

International Search Report of PCT/EP2020/052591, dated May 18, 2020.

*Primary Examiner* — Audrey B. Walter
*Assistant Examiner* — Dapinder Singh
(74) *Attorney, Agent, or Firm* — Collard & Roe, P.C.

(57) ABSTRACT

A rotary piston pump, in particular a claw pump, includes a housing which, when placed in a customary manner, has a housing inlet in a housing upper side. In order to further improve a rotary piston pump in a beneficial way, the housing inlet is connected to a gas channel that is integrated in the housing and extends transversely to a rotational axis of the piston, which gas channel creates a flow connection to a gas outlet of a filter part arranged in a filter receptacle. In the installed state, the filter part is accessible from a side perpendicular to the housing upper side, for maintenance purposes, for example.

10 Claims, 14 Drawing Sheets

(58) Field of Classification Search
CPC ..... F04C 18/0261; F04C 2/14; F04C 2/16; F04C 2230/85; F04C 2240/30; F04C 2250/101; F04C 2250/10; F04C 2250/102; F01C 21/007; F01C 21/10; F01C 1/16; F01C 1/0261
See application file for complete search history.

(56) References Cited

U.S. PATENT DOCUMENTS

| | | | | |
|---|---|---|---|---|
| 9,770,683 | B2 * | 9/2017 | Price | F04B 19/22 |
| 2013/0224050 | A1 * | 8/2013 | Nakagami | F04B 35/04 417/410.1 |

* cited by examiner

T
T
1
2
13
15
16
16
17
17
18
18
19
19
20
20
21
21
26
27
27
28
29
30
31
a
c
c
y
y

XIV
XIV
1
2
3
4
5
6
7
8
9
11
12
13
14
15
16
17
18
19
20
21
22
23
26
27
29
30
31
33
34
37
K
T
T
x
x
y
y
r
r
h
a
b
c
t
$U_1$
$U_2$
$U_3$

ROTARY PISTON PUMP HAVING A FILTER

CROSS REFERENCE TO RELATED APPLICATIONS

This application is the National Stage of PCT/EP2020/052591 filed on Feb. 3, 2020 which claims priority under 35 U.S.C. § 119 of German Application No. 10 2019 103 577.5 filed on Feb. 13, 2019, the disclosure of which is incorporated by reference. The international application under PCT article 21(2) was not published in English.

TECHNICAL FIELD

The invention relates to a rotary piston pump, in particular a claw pump, comprising a housing which, when placed in a customary manner, has a housing inlet on a housing upper side.

PRIOR ART

Rotary piston pumps, in particular claw pumps, are known. Reference is made, for example, to WO 2016/034485 A2. Conveying a gas is carried out by two interacting rotary pistons which are usually rotated in opposite directions, in the case of a possible claw pump, the claws of one piston engaging in recesses of the other piston.

In this context, it is further known to arrange a filter unit upstream of the housing inlet in the gas flow direction.

Known from DE 19927531 A1 is a rotary piston pump in which the air path is invariably predetermined by a gas inlet formed separately from the housing inlet.

SUMMARY OF THE INVENTION

Based on the prior art described above, the invention is concerned with the object of providing an advantageously formed rotary piston pump.

This object is achieved with a rotary piston pump according to the present invention, wherein it is intended that a modular design is provided which, on the one hand, allows using an integrated filter part for cleaning the gas before it flows into a pump chamber, wherein the filter receptacle is connected to a gas inlet which is formed separately from the housing inlet, and, on the other hand, allows a combination of the housing inlet, which is exposed after removal of a lid part, with a suction attachment, wherein in this configuration, the housing inlet directly forms the gas inlet.

A solution is thus created, with regard to the arrangement and design of the gas channel between the filter part and the housing inlet, in which the gas channel can be incorporated completely, but, where appropriate, also only partially, with regard to its longitudinal extent and/or its vertical extent—with respect to a customary placement of the rotary piston pump—into the outer device contour of the rotary piston pump.

Thus, the gas channel can be formed and arranged in such a manner that it does not protrude or does not protrude significantly beyond the housing contour of the rotary piston pump. In the case of a partially integrated solution, for example, with respect to a vertical section through the rotary piston pump placed in a customary manner, the resulting gas channel extends both on the outside of the pump housing, which extends further on both sides of the gas channel, and on the inside thereof, accordingly within the housing envelope spanned by the pump housing as a whole.

As a result, a space-saving design of a rotary piston pump with at least partially integrated gas channel and/or filter receptacle can be achieved.

According to the embodiments described above, the filter receptacle, in particular the filter part arranged therein, can also be partially or even completely integrated into the outer contour of the pump housing as a whole.

The accessibility of the filter part from a side face of the rotary piston pump can prove advantageous in terms of handling.

Alternatively, the housing inlet can be exposed after removal of the lid part and combined with the suction attachment which then forms the gas inlet without using the gas channel and the filter part arranged in the filter receptacle. This provides a modular design of the rotary piston pump which allows the pump to be used with the filter part, which can be partially integrated, where appropriate, and with the gas channel or, alternatively, with a suction attachment arranged directly at the housing inlet, accordingly bypassing the filter part at the pump. In this case, the suction attachment can comprise or lead to an external filter.

Thus, the filter receptacle can be connected to a gas inlet that is formed separately from the device inlet. Accordingly, according to one possible embodiment or configuration, the device inlet can be connected to the separate gas inlet via the gas channel and the filter receptacle. Thus, according to a preferred configuration, the gas sucked in via the gas inlet is inevitably guided through the filter receptacle and thus through the filter part accommodated in the filter receptacle.

Accordingly, the filter receptacle preferably comprises a gas inlet and a gas outlet.

The gas inlet may be formed for a gas inlet flow which flows in the same direction as a gas flow of the housing inlet. The same direction can here be achieved at least substantially, for example with respect to a definition of the direction by specifying angular degrees by a possible deviation of up to 5 or 10 degrees, moreover up to, for example, 45 degrees. Furthermore, in a preferred housing inlet on the housing upper side, a related gas flow in the housing inlet can thus be substantially perpendicular to a housing surface. Accordingly, the direction of the gas inlet flow can also run in the same direction and thus directed perpendicular to a plane formed by the housing upper side.

The filter part can be a round filter part through which the gas to be filtered can flow substantially from radially outside to axially inside. This can be, for example, an annular or cylindrical filter cartridge, further comprising, for example, a folded filter, for example, a filter made of a fiber medium or the like folded in a zigzag shape.

Also, the circular filter part can have a longitudinal axis with the filtered gas flowing through the filter part substantially in the direction of the longitudinal axis, in particular exiting the filter part in the direction of the longitudinal axis.

According to a possible embodiment, the filtered gas can be directed, downstream of the round filter part in the direction of flow of the gas, into the gas channel by being deflected by about 90°. The flow direction in question of the filtered gas immediately after the round filter part can thus be, for example, in the opposite direction of the flow direction of the gas inlet flow in the gas inlet and/or the gas flow in the housing inlet. Thus, in this regard, the result can be a gas flow immediately after leaving the round filter part that flows substantially vertically upward in the direction of the gas channel.

Furthermore, after the first 90 degree deflection described above, the filtered gas can flow through the gas channel with a further 90 degree deflection. For example, as is also preferred, the gas flow can be deflected from a flow direction vertically upward to a direction substantially horizontal in the direction toward the housing inlet when the rotary piston pump is placed in a customary manner.

Moreover, the filtered gas can be subjected to a further 90 degree deflection to form the gas flow of the housing inlet, thus, for example, to a deflection from a substantially horizontal flow direction to a flow direction directed substantially vertically downward.

Within the meaning of the invention, the aforementioned 90 degree deflections are also given if, in this respect, a right angle, corresponding to exactly 90 degrees, is not necessarily met in the sense of an angle specification. Rather, deflections in an angular range of plus/minus 10 to 20 degrees relative to the specified 90 degrees can also be given in this respect.

The gas channel can be formed in two parts with a parting plane which, with respect to a customary placement of the rotary piston pump, extends horizontally. In the usual operation of the rotary piston pump, in which operation the gas channel is used within the meaning of the invention, the horizontal parting plane is preferably closed in a gas-tight manner.

With respect to a vertical section through the rotary piston pump in the customary placement thereof, the horizontal parting plane may extend below a boundary plane of the rotary piston pump given by the surrounding housing surface, alternatively also within this plane or, as is moreover also preferred, above this plane, so that this parting plane is accessible from the outside, if necessary.

Thus, a lower part of the gas channel can be formed in the housing and an upper part can be formed by a separately placeable lid part. The lid part can be placed, in particular placed in a sealing manner, onto the lower part to form the gas channel.

In such a configuration, the housing inlet can open into the lower part of the gas channel, so that the housing inlet can be exposed after removal of the lid part. Furthermore, after removal of the lid part, the gas outlet can also be exposed.

In a further configuration, two filter receptacles are provided, each having a filter part. In such a configuration, both filter parts can be connected between the gas inlet and the gas outlet, so that a flow can pass through both filter parts during operation of the rotary piston pump. Preferably, in terms of flow, these two filter parts are provided in a parallel arrangement.

BRIEF DESCRIPTION OF THE DRAWINGS

Hereinafter, the invention is explained with reference to the accompanying drawing, which, however, merely shows exemplary embodiments. A part which is explained only with reference to one of the exemplary embodiments and which is not replaced by another part in a further exemplary embodiment due to the special feature highlighted therein is thus also described for this further exemplary embodiment as a possible existing part in any case. In the drawing:

FIG. 3 shows the end view of the rotary piston pump according to arrow III in FIG. 1;

FIG. 7 shows an illustration corresponding to FIG. 4, but after removal of the lid part and after direct attachment of a suction attachment to a housing inlet;

FIG. 9 shows the embodiment according to FIG. 8 in a partial sectional perspective view, relating to the gas channel provided with a valve;

DESCRIPTION OF THE EMBODIMENTS

Figure 1:
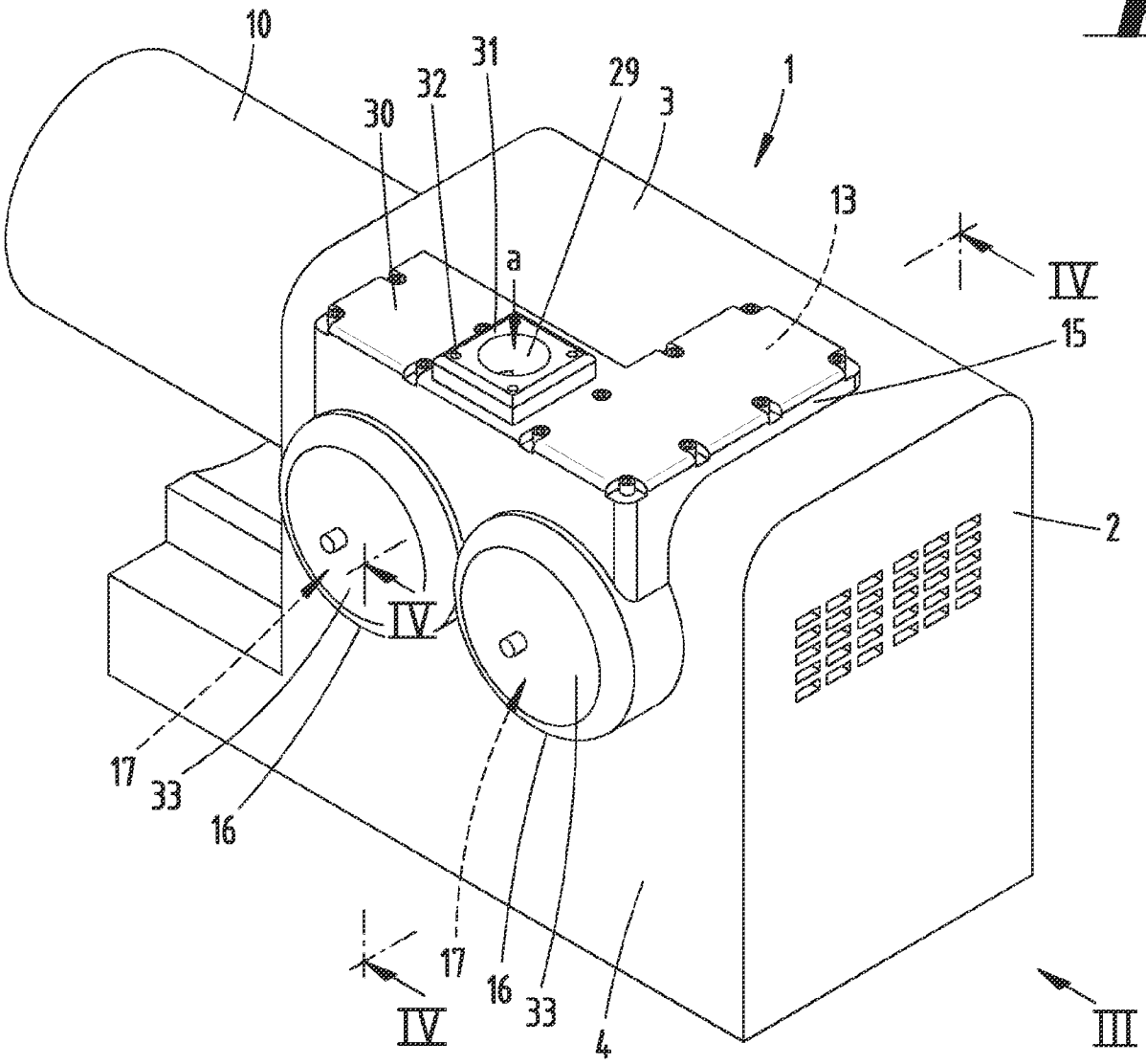
FIG. 1 shows a perspective view of a rotary piston pump of the type in question, relating to the customary placement.
Figure 2:
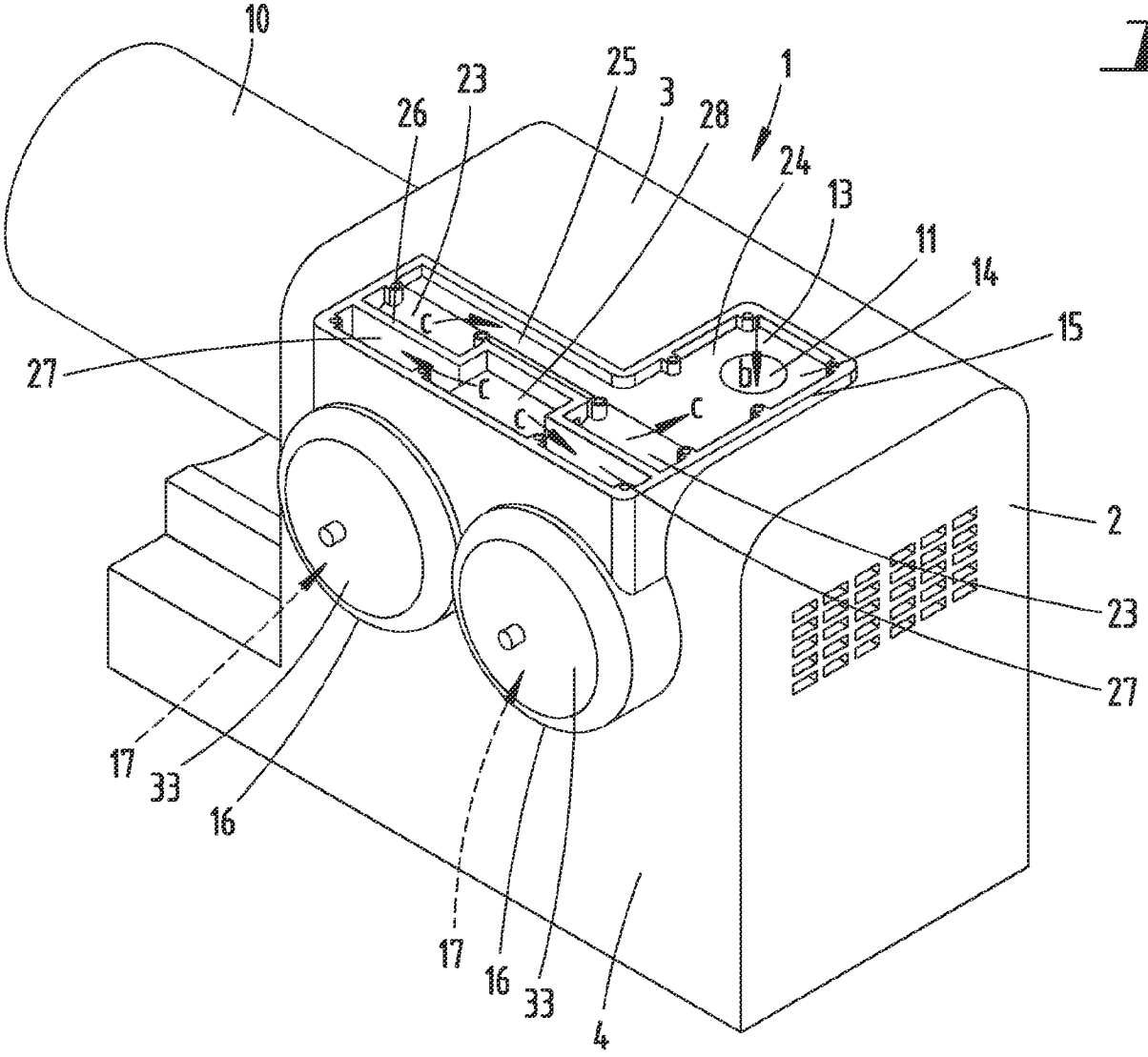
FIG. 2 shows an illustration corresponding to FIG. 1, but after removal of a lid part of a gas channel integrated in the housing of the rotary piston pump.
Figure 5:
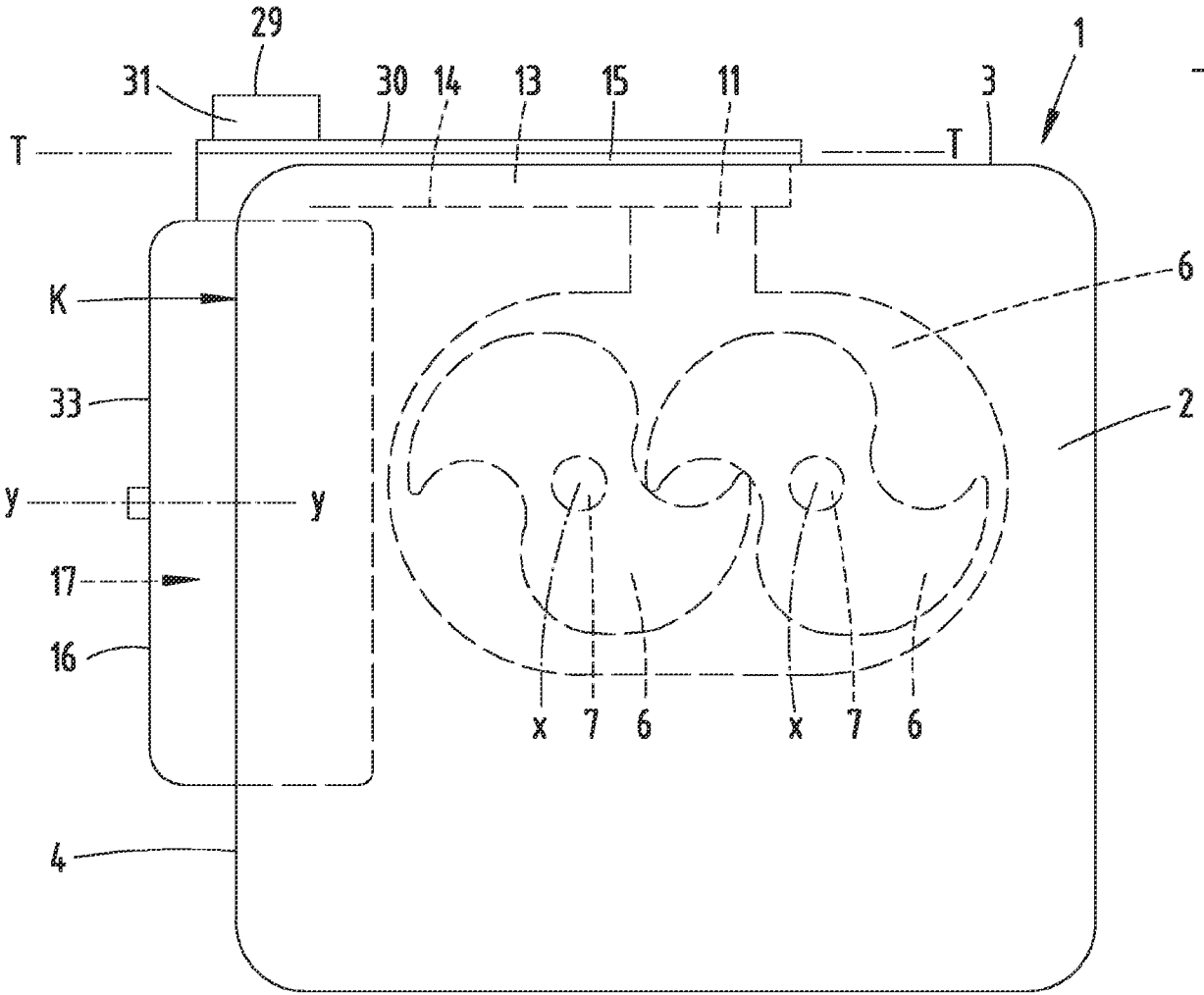
FIG. 5 shows the schematic section according to the line V-V in FIG. 4.

Illustrated and described, in first instance with reference to FIG. 1, is a rotary piston pump 1, here in the form of a claw pump, with a housing 2.

The housing 2, when placed in a customary manner, as incidentally illustrated in drawings in this way, has a housing upper side 3 and a side 4 substantially aligned perpendicularly to the housing upper side 3.

Figure 4:
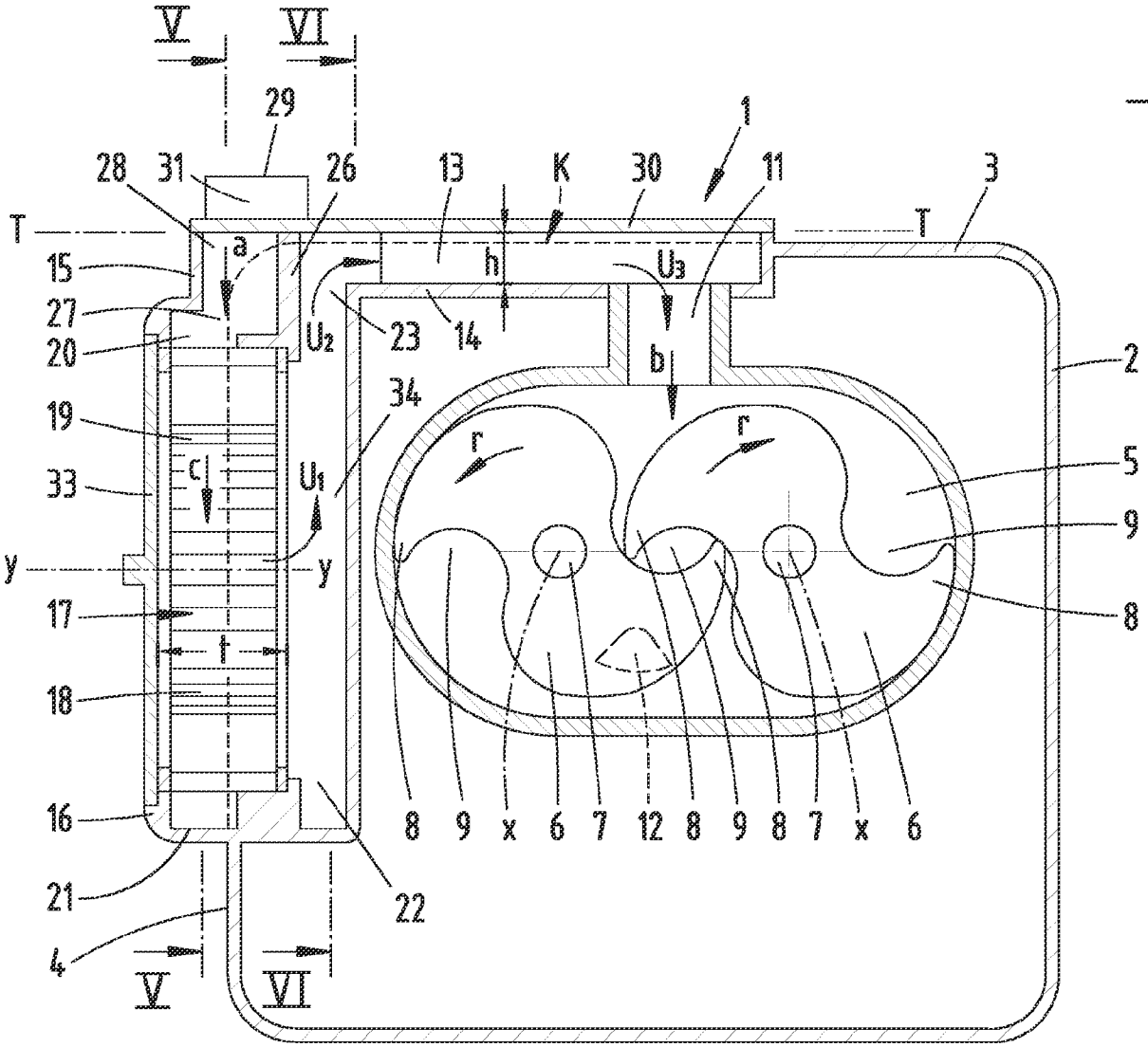
FIG. 4 shows a schematic sectional view through the rotary piston pump according to sectional plane IV in FIG. 1.
Figure 5:
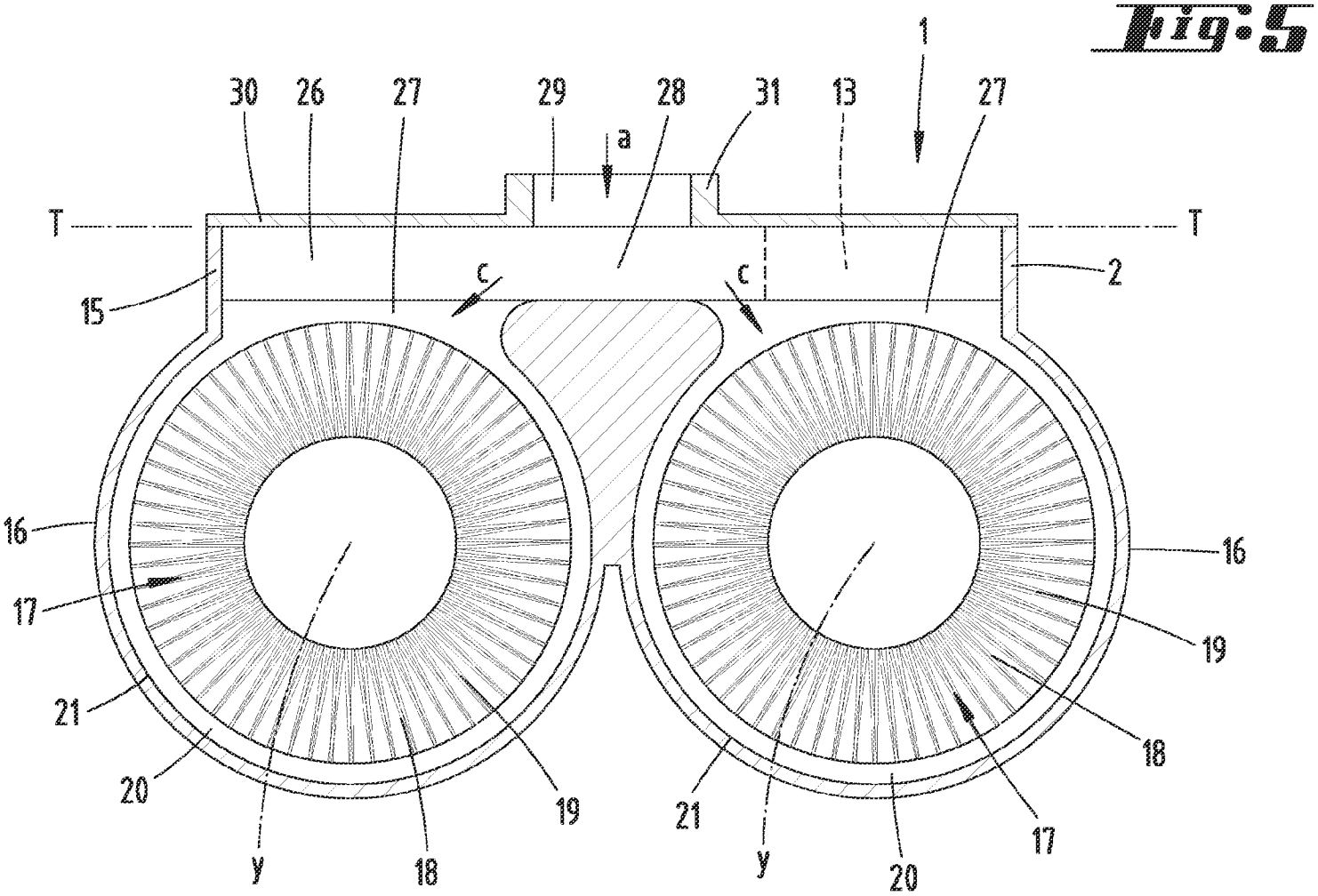
Figure 6:
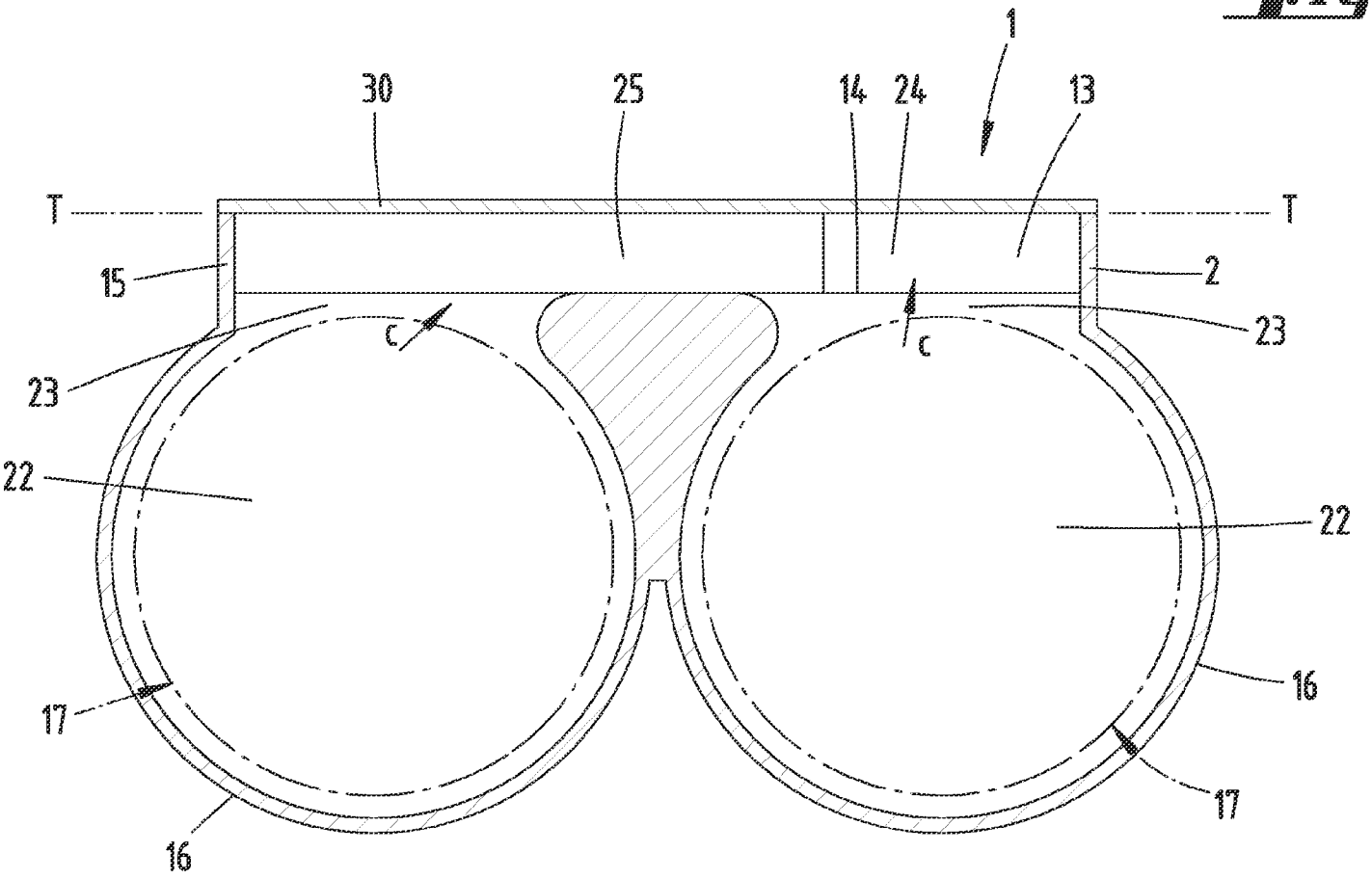
FIG. 6 shows the schematic section according to the line VI-VI in FIG. 4.
Figure 1:
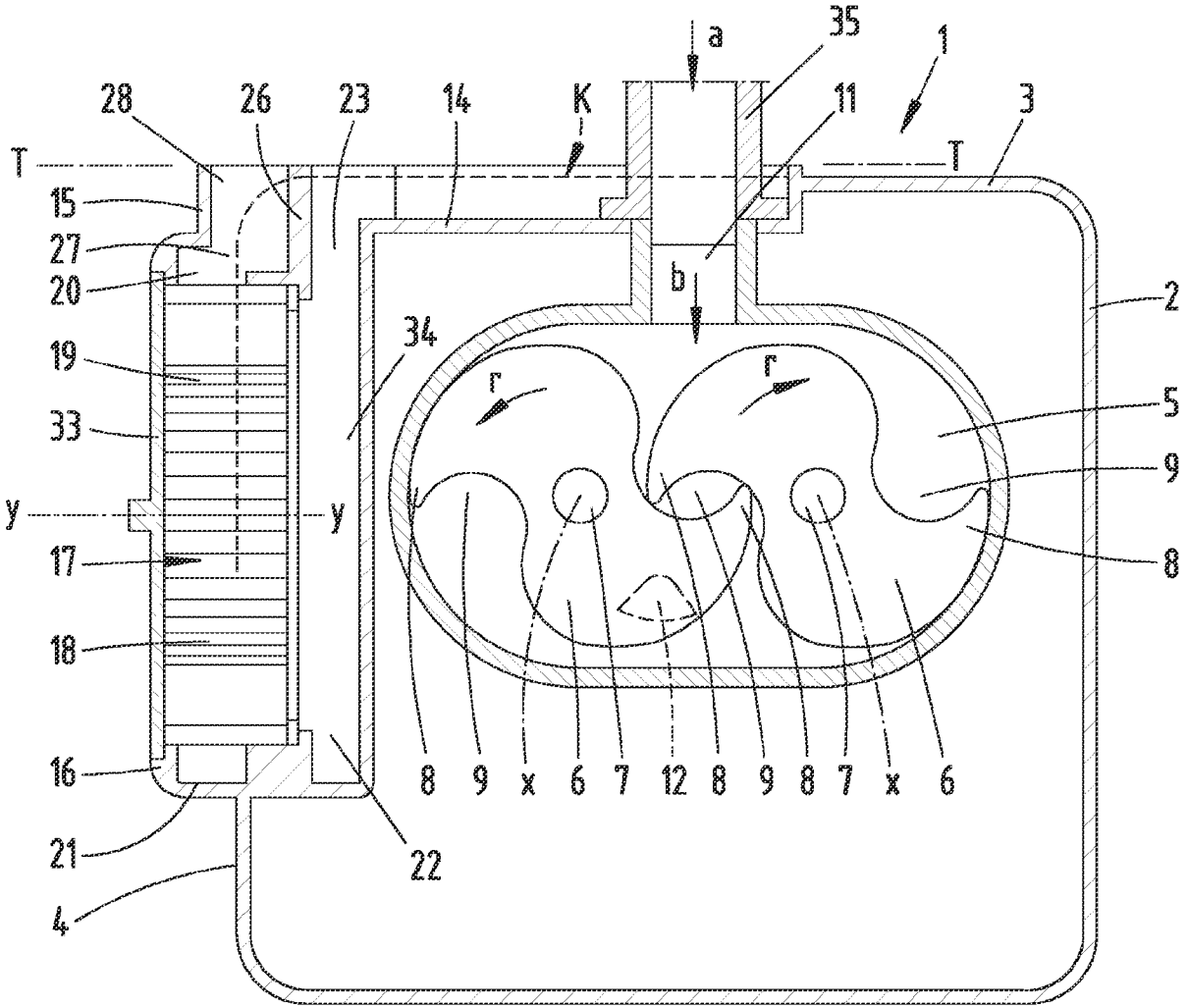

In particular with reference to a vertical section according to FIG. 4, the housing 2 forms an outer circumferential contour K.

As can be seen in particular from the schematic illustrations in FIGS. 3 and 4, two rotary pistons 6 are arranged in a pump chamber 5. These rotary pistons each rotate about a shaft 7, the geometric rotational axes x of which run in the same direction, parallel to one another and, when placed in customary manner, in a horizontal plane.

In the illustrated embodiment of the rotary piston pump 1 as a claw pump, in each case two claws 8 of a rotary piston 6 engage in recesses 9 of the other rotary piston 6, namely with the two rotary pistons 6 rotating in opposite directions of rotation r with respect to each other.

The rotary pistons 6 are driven, for example, by a motor 10, in particular an electric motor, arranged directly on the housing 2.

The pump chamber 5 has a housing inlet 11 and a chamber outlet 12.

When the rotary piston pump 1 according to FIG. 1 is placed in a customary manner, the housing inlet 11 is associated with the housing upper side 3.

Likewise, and also preferably, a gas channel 13 associated with the housing upper side 3 can be provided which can extend transversely to the orientation of the rotational axes x of the rotary pistons 6. In particular, the gas channel 13 leads substantially from the housing inlet 11 towards the side 4 of the housing 2.

The housing inlet 11 opens into the gas channel 13 at the bottom.

The gas channel 13 is substantially integrated into the housing 2, but, according to the embodiments shown, can project upwards beyond the contour K of the housing 2 and thus upwards beyond the housing upper side 3 surrounding the gas channel 13.

In the exemplary embodiments shown, with respect to its height h as viewed perpendicular to the longitudinal extent, the gas channel 13 extends with a larger portion, for example two thirds of this height h, below the contour K and thus completely within the housing 2, and with a smaller portion, for example one third of the height h, above the contour K.

The bottom 14 and/or the channel walls 15 substantially laterally delimiting the gas channel 13 can be part of the housing 2. Thus, they can be formed from the same material and, if necessary, integrally with the housing 2.

Figure 11:
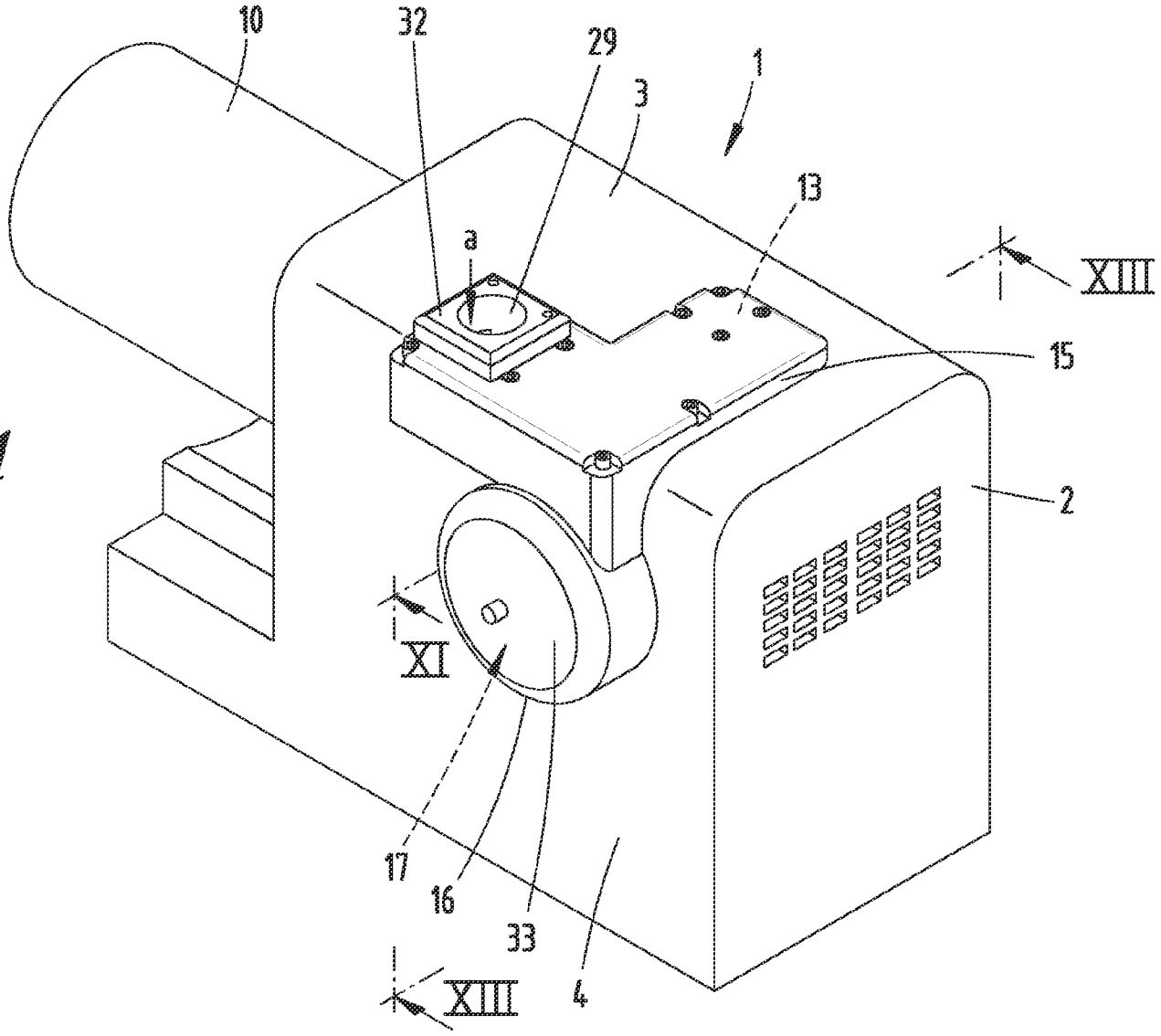
FIG. 11 shows a perspective view corresponding substantially to FIG. 1 of a rotary piston pump in a further embodiment.
Figure 12:
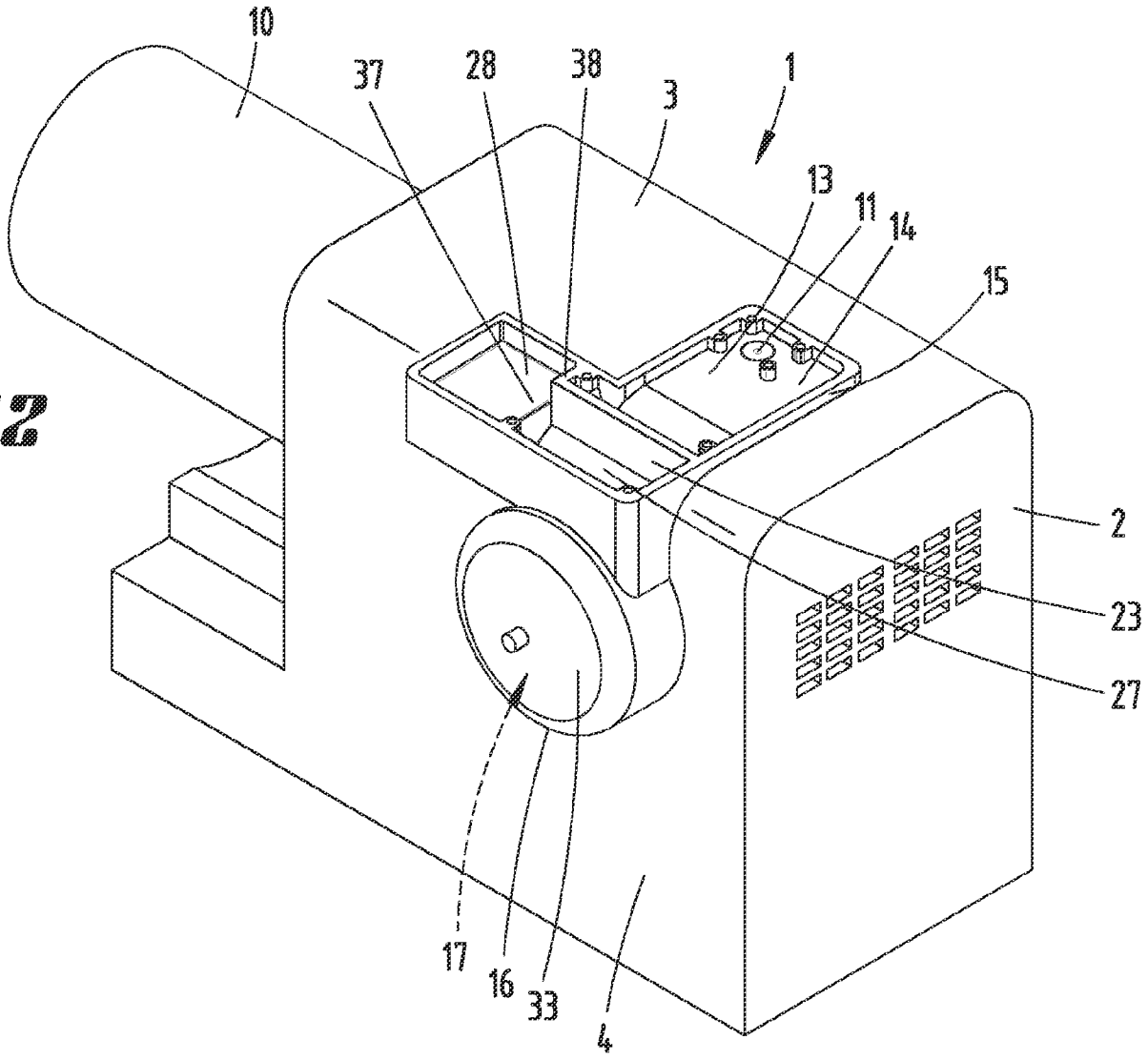
FIG. 12 shows an illustration corresponding to FIG. 2, relating to the embodiment according to FIG. 11.
Figure 13:
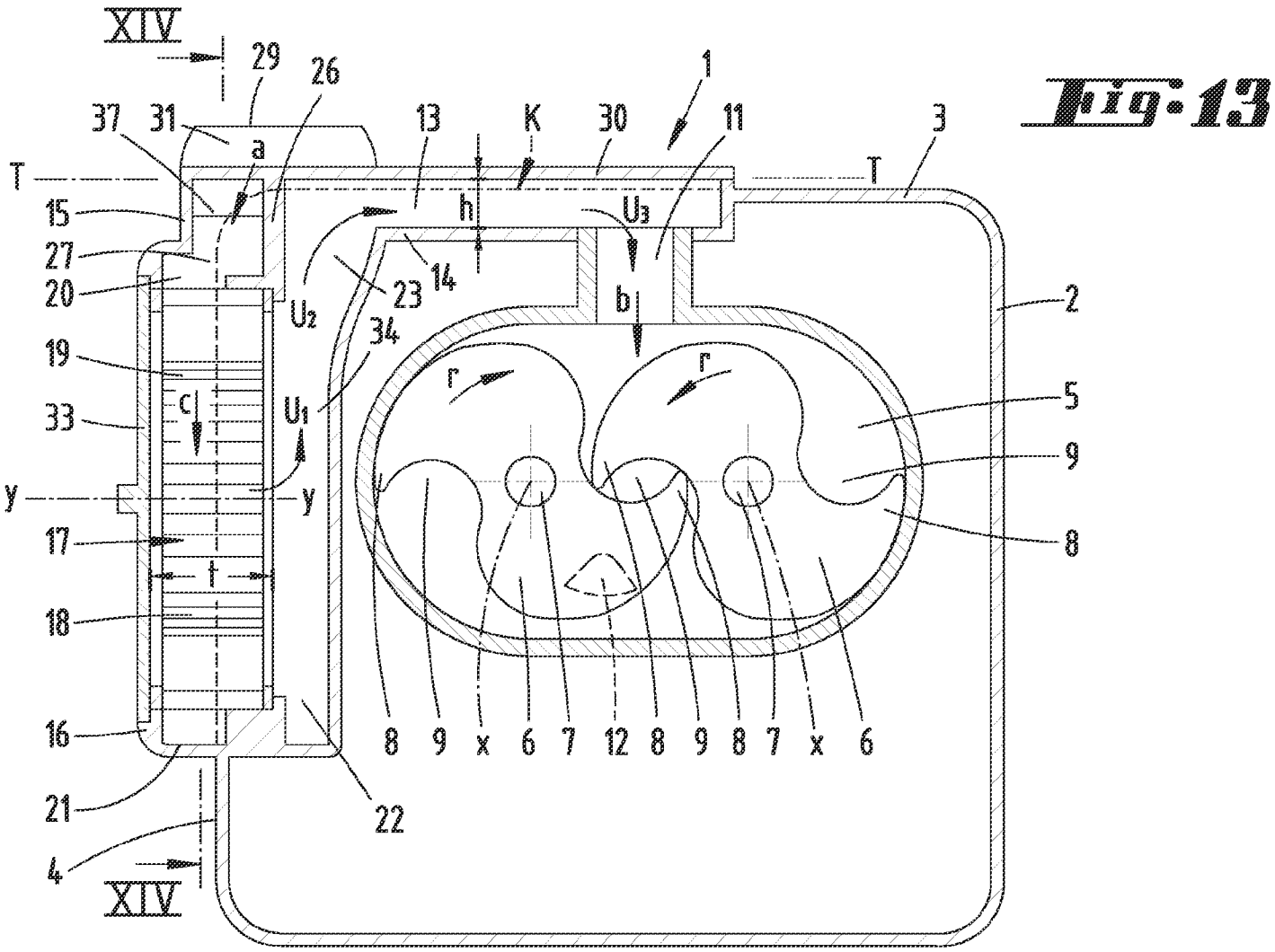
FIG. 13 shows a sectional view of the embodiment according to FIG. 11.

On the side 4, which in the illustrated exemplary embodiment corresponds substantially to a longitudinal side of the rotary piston pump 1 as a whole, two filter receptacles 16 can be provided according to the embodiments illustrated, for example, in FIGS. 1 to 8, for accommodating one filter part 17 in each case. The illustrations in FIGS. 11 to 13 show an embodiment with only one filter part 17.

Each filter receptacle 16 first and foremost forms a receptacle housing, which can be a component of the pump housing 2 as a whole.

The filter part 17, as illustrated, can be a round filter part 18 with a central geometric axis y which can be oriented transversely to the rotational axes x of the rotary pistons 6 (compare also FIG. 4).

Each filter part 17 can be shaped in the manner of a filter cartridge, for example comprising a filter element 19 folded in a zigzag shape.

The filter parts 17, as illustrated, can also be arranged partially integrated into the housing contour so that such a filter part 17, with respect to its depth t as viewed in the axial direction, can extend inside the housing contour K and with another part outside the housing contour K. This partial integration can also be shown on the outside by a corresponding configuration of the filter receptacle 16 in question, which, according to the illustrated exemplary embodiment, protrudes with respect to the surface of the housing side 4 by approximately half the depth dimension t of the filter part 17.

Figure 14:
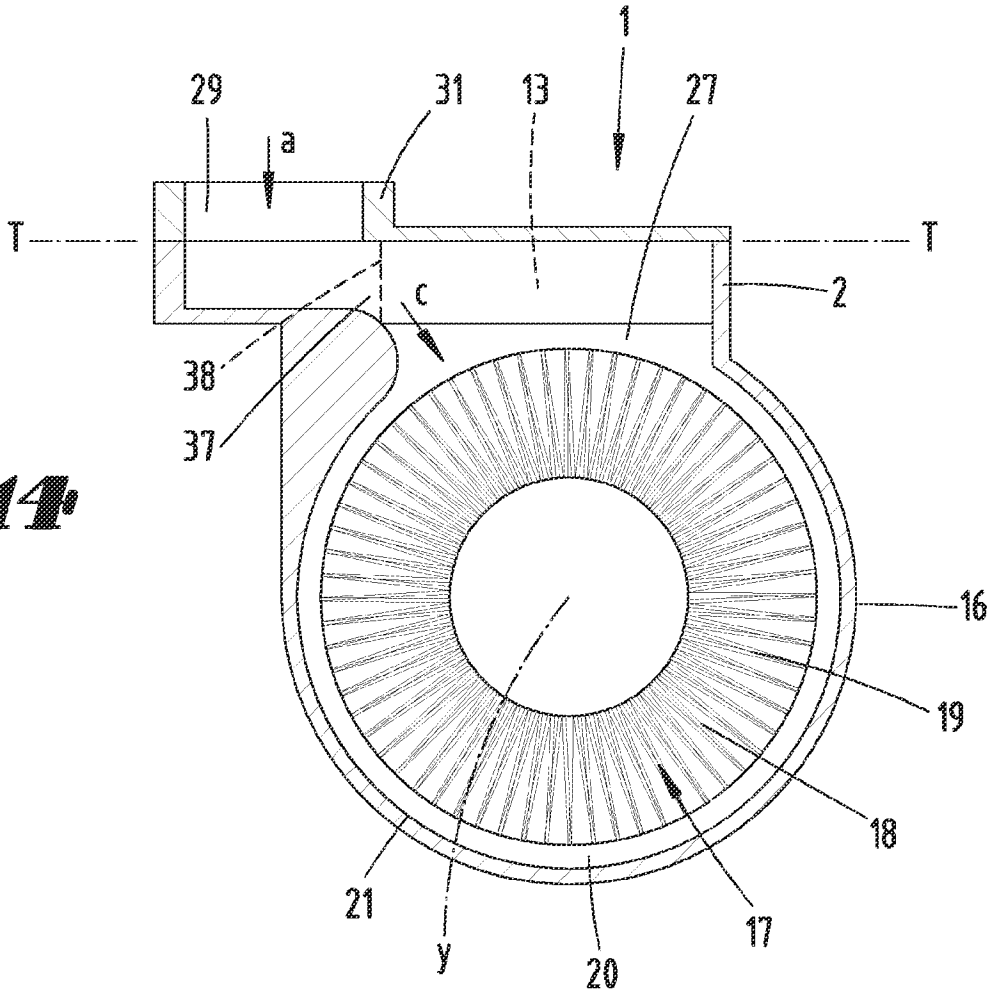
FIG. 14 shows an illustration corresponding to FIG. 5, relating to the embodiment according to FIG. 11.

The respective filter receptacle 16 is designed for radial inflow of the filter part 17 accommodated in the filter receptacle 16. This results approximately in an annular inflow space 20 completely encompassing the filter part 17 between a circumferential outer contour of the filter part 17 and an inner wall 21 of the filter receptacle 16 (compare FIG. 5 or 14).

At the outlet, the filter receptacle 16 and thus the filter part 17 accommodated therein is connected to an outflow channel 22. The latter, as illustrated, can extend completely within the housing 2 in the vertical direction when the rotary piston pump 1 is placed in a customary manner. The outflow channel 22 associated with the housing upper side 3 opens into the gas channel 13.

Moreover, the outflow channel 22 can extend in substantially the same directional orientation as the housing inlet 11 of the pump chamber 5.

The outflow channel 22 of the one filter receptacle 16 or, respectively, the outflow channels 22 of both filter receptacles 16 or both filter parts 17, respectively, enter the gas channel 13 in the region of an outflow opening 23, for which purpose, in the case of a dual arrangement of filter parts 17 for connecting both outflow openings 23, the gas channel 13 has, with respect to a top view of the housing upper side 3, a portion 25 angled at approximately 90 degrees with respect to the portion 24 leading to the housing inlet 11. This portion 25, as is also preferred, can have the same height h as the portion 24 leading to the housing inlet 11. Also, the portions 24 and 25 can have the same bottom 14, as well as the same, preferably circumferential, channel wall 15 (compare FIG. 2).

Adjacent to the outflow openings 23 but separated in a flow-tight manner by a partition wall 26, an inflow opening 27 associated with each filter receptacle 16 can be provided, which opens into the respective annular inflow space 20.

If two filter parts are provided, both inlet openings 27 can be connected to each other in terms of flow via a distribution channel 28. In this case, a central, outwardly directed gas inlet 29 can preferably open into the distribution channel 28.

In a single-filter solution, the gas inlet 29 can be provided adjacent to the inflow opening 27, connected via an aperture 37 in a wall 38 separating the gas inlet 29 from the outflow opening.

With reference to a customary placement of the rotary piston pump, the result can be a two-part arrangement of the gas channel 13 and, moreover, preferably also of the portion 25 having the outflow and inflow openings, with a horizontal parting plane T. The latter is created in the region of a support plane of a lid part 30 on the end face of the circumferential channel wall 15, which faces upwards in the customary placement state.

The lid part 30 can preferably be arranged on the channel wall 15 in a flow-tight manner, for example by means of a provided screw connection, as also illustrated.

In the closed position, the lid part 30 preferably also rests sealingly on the partition wall 26, thereby preferably overlapping both the portion 24 and the portion 25. As an alternative to the one-piece configuration of the lid part 30, the latter can also be of multi-part design, for example comprising a lid part portion solely for the portion 24.

The gas inlet 29, as is also preferred, can be provided in the form of a corresponding aperture in the lid part 30, which aperture, according to the illustrated exemplary embodiments, can be moved into a plane of spacing from the housing upper side 3 by a chimney-like superstructure 31 on the lid part 30.

The superstructure 31 can have fastening means 32 by means of which, for example, a suction attachment or the like can be arranged on the superstructure 31 and thus on the gas inlet 29.

Each filter part 17 is accessible from the housing side 4 via a removable cover 33 of the filter receptacle 16, for maintenance purposes, for example. This cover 33 can be transparent, so that even with the cover 33 being arranged in place, the state of contamination of the filter part 17 arranged therebehind can be seen.

The gas inlet 29 is formed for a gas inlet flow a, which is preferably directed in the same direction as the gas flow b of the housing inlet 11. Thus, in a preferred configuration, both flows a and b are directed perpendicular to the housing upper side 3, with a flow direction from top to bottom in the customary placement of the rotary piston pump 1.

The gas flowing in through the gas inlet 29 is distributed via the distribution channel 28 to the two filter receptacles 16 after passing through the gas inlet 29 and flowing through the inlet openings 27, wherein in the region of the filter receptacles 16, the gas to be filtered flows through the respective filter part 17 or, respectively, the round filter part 18 substantially from radially outside to radially inside. In this case, the gas continues to flow towards the respective gas outlet 34, tending in the direction of the axis y.

Downstream of the filter part 17 as viewed in the flow direction c of the gas, the filtered gas is directed into the region of the gas outlet 34 via a first 90° deflection $U_1$ through the outflow channel 22 and through the outflow opening 23 into the gas channel 13. The flow direction in question within the outflow channel 22 towards the gas channel 13, as is also preferred, can be in the opposite direction of the gas flows a and b in the region of the gas inlet 29 and the housing inlet 11.

Hereafter, the flow flows with a further 90° deflection U2 through the gas channel 13 such that a gas flow substantially in horizontal direction is created within the gas channel 13.

To generate the gas flow b in the housing inlet 11, the filtered gas is subjected to a further, third 90° deflection U3 at the end of the flow through the gas channel 13 (compare FIG. 4).

A modular design can be created, which allows the use of the integrated filter parts 17 for cleaning the gas before it flows into the pump chamber 5. Furthermore, after removing the cover part 30, the housing inlet 11 can be exposed, for example for directly attaching a suction attachment 35, so that the rotary piston pump 1 can be used without using the gas channel 13 and without the filter parts arranged in the filter receptacles 16. In this configuration, the housing inlet 11 directly forms the gas inlet (compare FIG. 7).

Figure 8:
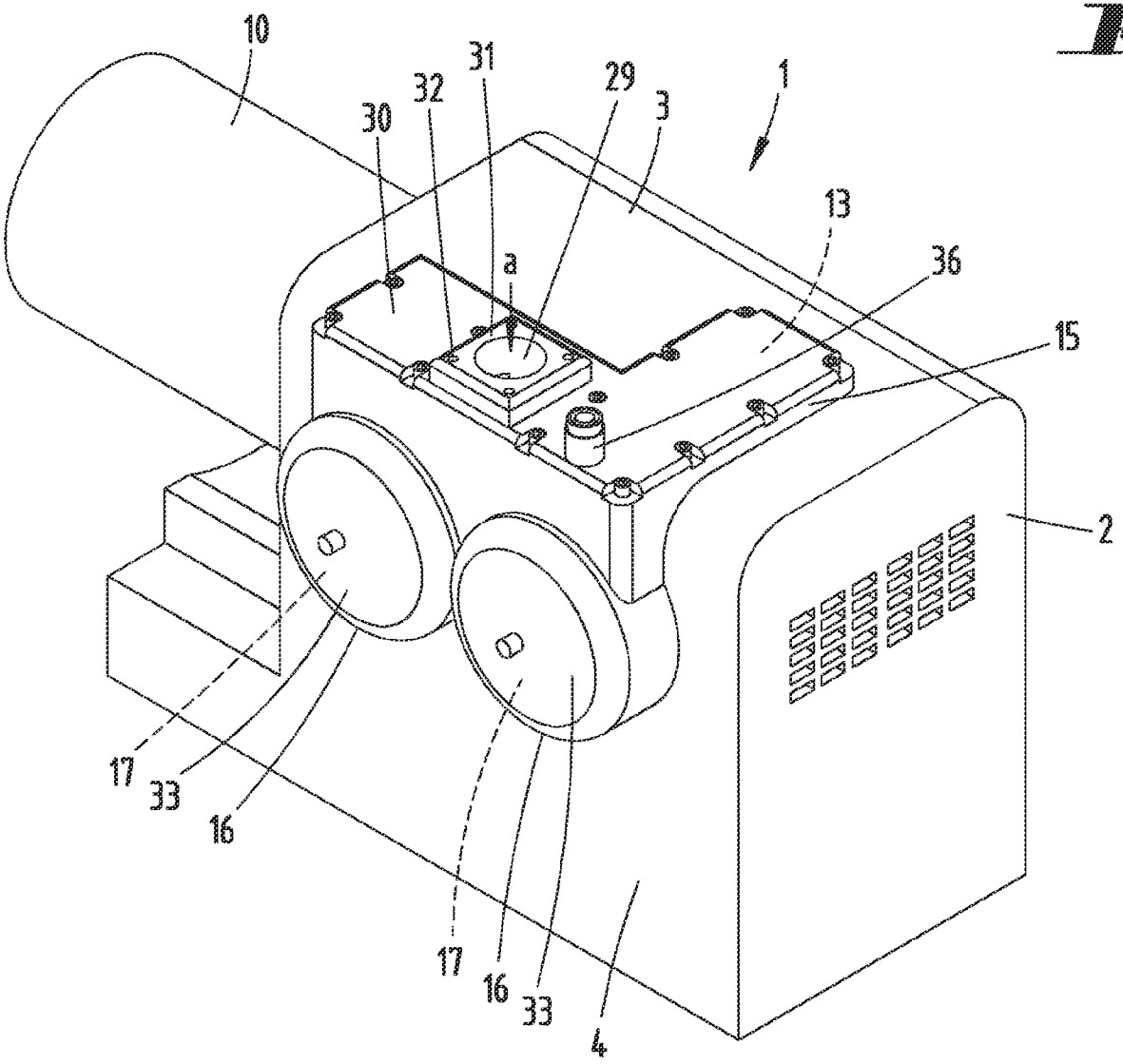
FIG. 8 shows an illustration corresponding to FIG. 1, relating to a second embodiment.
Figure 5:
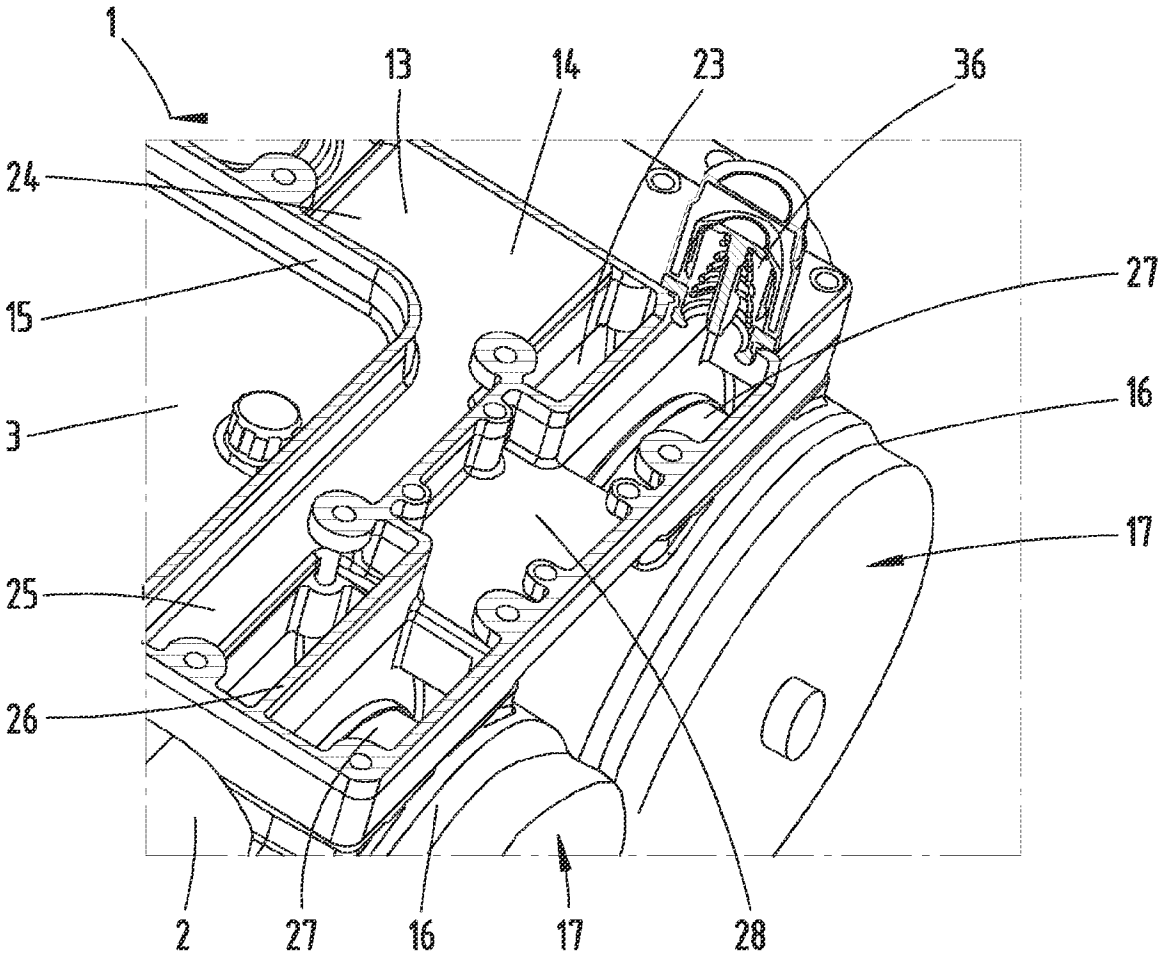

According to the embodiment in FIGS. 8 and 9, furthermore, a valve 36 can be arranged, for example, on the cover part 30, comprising a conduit connection to the distribution channel 28 leading to the inlet openings 27 in the flow direction c upstream of the filter parts 17. Accordingly, such a valve 36 is connected in the flow direction between the gas inlet 29 and the filter parts 17 and opens, for example, in the event of incorrect operation.

Figure 10:
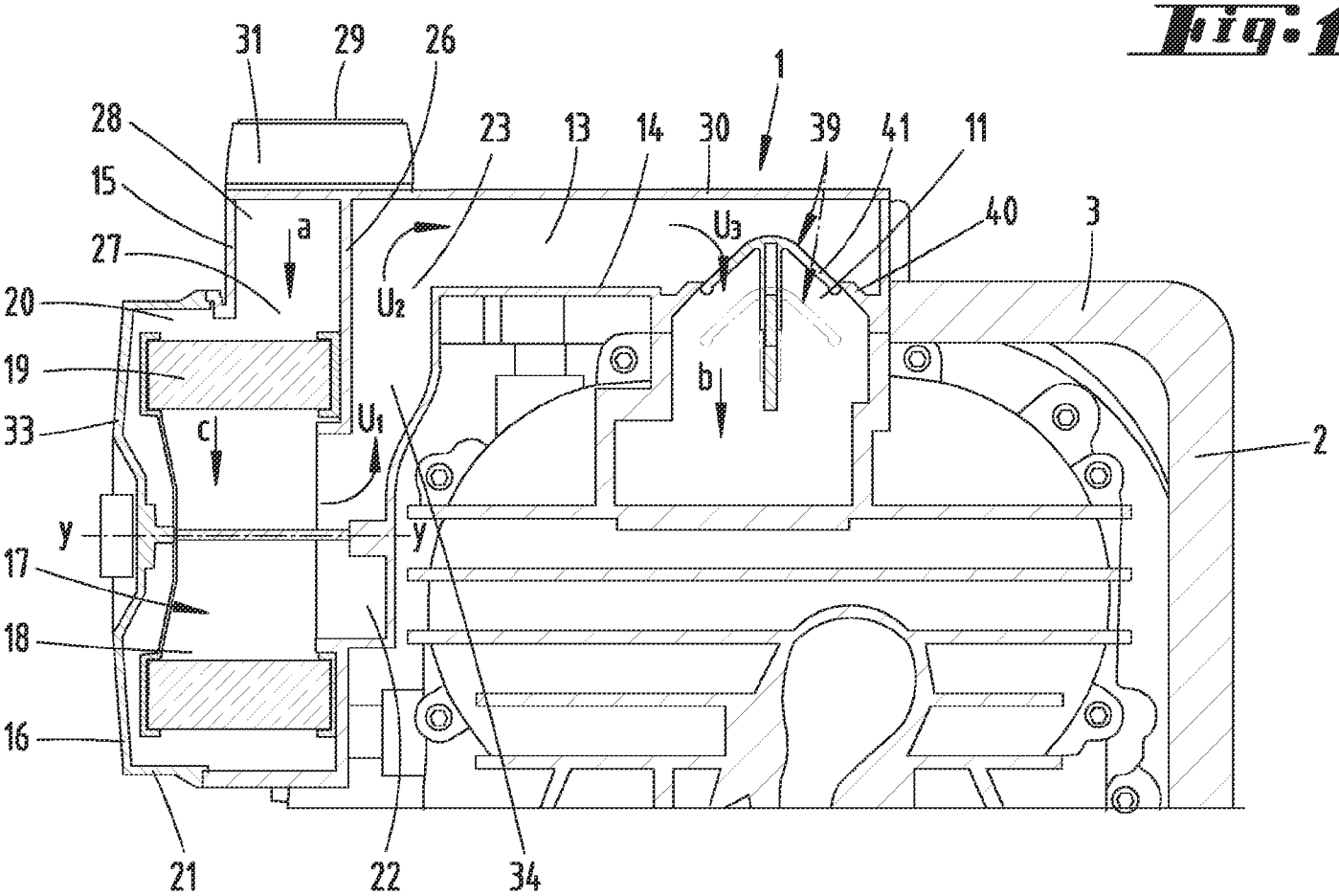
FIG. 10 shows a sectional view according to FIG. 4, relating to a further embodiment with a check valve.

As shown in the further embodiment in FIG. 10, a check valve 39 can be provided in particular in the region of the housing inlet 11, with an umbrella-shaped valve body 41 which, in a valve closing position, as illustrated, acts in a sealing manner against a valve seat 40 by means of a circumferential sealing-lip-like sealing edge. In this case, as is preferred, the valve body 41 can be forced into the valve seat 40, for example, under the action of spring force. The housing inlet 11 is closed in this position.

Only upon switching on the rotary piston pump 1 and an accompanying buildup of a gas flow, the valve body 41 is lifted from the valve seat 40 against the reset force of the optionally provided spring, and the housing inlet 11 is opened (see dotdashed illustration in FIG. 10).

When the rotary piston pump 1 is switched off, the check valve 39 automatically falls into the closed position.

The foregoing explanations serve to explain the inventions which are covered by the application as a whole and each of which, also independently, further refine the prior art at least by means of the following combinations of features, wherein two, more or all of these combinations of features can also be combined, namely:

A rotary piston pump, which is characterized in that the housing inlet 11 is connected to a gas channel 13 integrated in the housing 2 and extending transversely to a rotational axis x of the piston 6, which gas channel creates a flow connection to a gas outlet 34 of a filter part 17 arranged in a filter receptacle 16, wherein, in the installed state, the filter part 17 is accessible from a side 4 perpendicular to the housing upper side 3, for maintenance purposes, for example.

A rotary piston pump, which is characterized in that the filter receptacle 16 is connected to a gas inlet 29 formed separately from the housing inlet 11.

A rotary piston pump, which is characterized in that the gas inlet 29 is formed for a gas inlet flow a that flows in the same direction as a gas flow b of the housing inlet 11.

A rotary piston pump, which is characterized in that the filter part 17 is a round filter part 18 through which the gas to be filtered can flow from radially outside to axially inside.

A rotary piston pump, which is characterized in that downstream of the filter part 17 in the flow direction c of the gas, the filtered gas is directed into the gas channel 13 by being deflected by approximately 90°.

A rotary piston pump, which is characterized in that after the first 90° deflection U1, the filtered gas flows through the gas channel 13 with a further 90° deflection U2.

A rotary piston pump, which characterized in that the filtered gas is subjected to a further 90° deflection U3 to form the gas flow b of the housing inlet 11.

A rotary piston pump, which is characterized in that the gas channel 13 is formed in two parts, with a parting plane T extending horizontally with respect to a customary placement of the rotary piston pump 1.

A rotary piston pump, which is characterized in that a lower part of the gas channel 13 is formed in the housing 2, and an upper part is formed by a separately attachable lid part 30.

A rotary piston pump, which is characterized in that after removal of the lid part 30, the housing inlet 11 is exposed.

A rotary piston pump, which is characterized in that the exposed housing inlet 11 is combinable with a suction attachment 35 which forms the gas inlet 29 without using the gas channel 13 and the filter part 17 arranged in the filter receptacle 16.

A rotary piston pump, which is characterized in that two filter receptacles 16 each having one filter part 17 are provided.

All features disclosed are (in themselves) pertinent to the invention. The disclosure content of the associated/accompanying priority documents (copy of the prior application) is also hereby included in full in the disclosure, including for the purpose of incorporating features of these documents in the claims in the present application. The subsidiary claims, even without the features of a referenced claims, characterize with their features independent inventive refinements of the prior art, in particular to undertake divisional applications based on these claims. The invention specified in each claim may additionally have one or more of the features specified in the above description, in particular those with reference numerals and/or specified in the reference list. The invention further relates to forms of design in which individual features mentioned in the above description are not implemented, in particular insofar as they are evidently dispensable for the respective intended use or can be replaced by other means having the same technical effect.

REFERENCE LIST

1 rotary piston pump
2 housing
3 housing upper side
4 side
5 pump chamber
6 rotary piston
7 shaft
8 claw
9 recess
10 motor
11 housing inlet
12 chamber outlet

13 gas channel
14 bottom
15 channel wall
16 filter receptacle
17 filter part
18 round filter part
19 filter element
20 annular inflow space
21 inner wall
22 outflow channel
23 outflow opening
24 portion
25 portion
26 partition wall
27 inflow opening
28 distribution channel
29 gas inlet
30 lid part
31 superstructure
32 fastening means
33 cover
34 gas outlet
35 suction attachment
36 valve
37 aperture
38 wall
39 check valve
40 valve seat
41 valve body
a gas inlet flow
b gas flow
c flow direction
h height
r direction of rotation
t depth
x rotational axis
y axis
K contour
T parting plane
$U_1$ first 90° deflection
$U_2$ second 90° deflection
$U_3$ third 90° deflection

The invention claimed is:

1. A rotary piston pump, in particular claw pump, comprising:

a housing which has a housing inlet on a housing upper side, wherein the housing inlet is connected to a gas channel that is integrated into the housing and extends transversely to a rotational axis (x) of a piston, a filter part arranged in a filter receptacle, wherein the gas channel creates a flow connection to a gas outlet of the filter part, wherein in an installed state, the filter part is accessible from a side perpendicular to the upper side of the housing, such as for maintenance purposes, wherein a modular design is provided, which allows the integrated filter part to clean the gas before the gas flows into a pump chamber, wherein the filter receptacle is connected to a gas inlet which is formed separately from the housing inlet, and allows a combination of the housing inlet, which is exposed after removal of a lid part, with a suction attachment so that the housing inlet directly forms the gas inlet.

2. The rotary piston pump according to claim 1, wherein the gas inlet is formed for a gas inlet flow (a) that flows in a same direction as a gas flow (b) of the housing inlet.

3. The rotary piston pump according to claim 1, wherein the filter part is a round filter part through which the gas to be filtered can flow from radially outside to axially inside.

4. The rotary piston pump according to claim 1, wherein the piston pump is configured such that downstream of the filter part in a flow direction (c) of the gas, the filtered gas is directed into the gas channel by being deflected by approximately 90°.

5. The rotary piston pump according to claim 4, wherein after the first 90° deflection, the filtered gas flows through the gas channel with a further 90° deflection (U2).

6. The rotary piston pump according to claim 5, wherein the filtered gas is subjected to a further 90° deflection (U3) to form the gas flow (b) of the housing inlet.

7. The rotary piston pump according to claim 1, wherein the gas channel is formed in two parts, with a parting plane (T) that is horizontal with respect to a customary placement of the rotary piston pump.

8. The rotary piston pump according to claim 7, wherein a lower part of the gas channel is formed in the housing, and an upper part of the gas channel is formed by a separately attachable lid part.

9. The rotary piston pump according to claim 8, wherein after removal of the lid part, the housing inlet is exposed.

10. The rotary piston pump according to claim 1, wherein two filter receptacles, each having one said filter part, are provided.

* * * * *